US005657543A

United States Patent [19]

Collins

[11] Patent Number: 5,657,543

[45] Date of Patent: Aug. 19, 1997

[54] EMERGENCY TOOL

[76] Inventor: Walter W. Collins, P.O. Box 100 4651 Savannah Hwy., North, S.C. 29112

[21] Appl. No.: 541,696

[22] Filed: Oct. 10, 1995

[51] Int. Cl.[6] ..... B26F 1/00; B25F 1/00; B26B 11/00

[52] U.S. Cl. ..... 30/367; 30/359; 30/123; 7/118; 7/158

[58] Field of Search ..... 30/367, 359, 123, 30/161, 164.6; 225/93, 103; 7/158, 118, 165, 100; 227/132, 146; 173/170

[56] References Cited

U.S. PATENT DOCUMENTS

| | | | |
|---|---|---|---|
| 278,951 | 6/1883 | Hartman . | |
| 797,824 | 8/1905 | Seitz | 30/367 |
| 825,063 | 7/1906 | Lawbaugh . | |
| 947,391 | 1/1910 | Michael | 30/367 |
| 949,470 | 2/1910 | Geissenhainer et al. | 30/164.6 |
| 1,424,221 | 8/1922 | Trumpeter | 30/164.6 |
| 1,512,689 | 10/1924 | Hermann . | |
| 1,530,688 | 3/1925 | Murray | 7/165 X |
| 2,798,290 | 7/1957 | Bassett . | |
| 4,268,926 | 5/1981 | Roxton | 7/143 |
| 4,447,950 | 5/1984 | Mizelle . | |
| 4,815,346 | 3/1989 | Littlehorn . | |
| 4,862,544 | 9/1989 | Wallace | 7/118 |
| 4,896,424 | 1/1990 | Walker . | |
| 4,901,439 | 2/1990 | Boyd, Jr. | 30/161 |
| 4,947,552 | 8/1990 | Barnes | 30/161 |
| 4,985,998 | 1/1991 | Howard | 30/158 |
| 5,009,008 | 4/1991 | Yablonovitch | 30/158 |
| 5,060,379 | 10/1991 | Neely . | |
| 5,095,624 | 3/1992 | Ennis | 30/161 |
| 5,097,599 | 3/1992 | Hasegawa | 30/395 |
| 5,125,157 | 6/1992 | Howard | 7/118 X |
| 5,153,995 | 10/1992 | Opinel . | |
| 5,251,351 | 10/1993 | Klotz | 7/100 |
| 5,442,529 | 8/1995 | Hoover | 7/118 X |
| 5,542,139 | 8/1996 | Boivin | 7/118 |

OTHER PUBLICATIONS

P. 54, Nov. 1994, issue of *Blade* magazine.

Buck Knives advertisement from Nov. 1994 *Blade* magazine.

*Primary Examiner*—D. S. Meislin

*Attorney, Agent, or Firm*—Leatherwood Walker Todd & Mann, P.C.

[57] ABSTRACT

An emergency tool for use in breaking glass. The tool includes a handle member having an impact member slidingly carried within a channel therein. A spring is provided for advancing the impact member outwardly from the handle in order to break glass upon the impact member's contact therewith. A trigger lever is provided for compressing the spring and cocking the impact member such that upon activation of the trigger, the impact member advances forward for breaking glass. Also provided is a folding blade extendable from the handle, having a serrated edge for cutting seat belts, and a pry member for prying off objects. A spring actuated locking member is also provided for automatically locking the blade in an extended position.

15 Claims, 5 Drawing Sheets

EMERGENCY TOOL

BACKGROUND OF THE INVENTION

This invention relates generally to a tool for use by law enforcement and emergency personnel for extracting persons and property from a vehicle when the breaking of windows, windshields, or the like is required.

The need may arise from time to time in law enforcement and with emergency rescue personnel to break open the glass of an automobile or truck that has been involved in an accident. When it becomes necessary to break the glass, it is desirable both to protect the occupants of the vehicle and the personnel breaking the glass. Therefore, it is important to provide a way to break the glass in as safe and controlled manner as possible. It is another important objective to be able to repeat this procedure in a reliable manner. Also important for use by such personnel in extracting persons from automobiles is a device for rapidly and safely cutting an automobile's safety belt, particularly if the safety belt latch is inoperable. A device is necessary which not only cuts the belt quickly, but which also minimizes risk to the seatbelt wearer from injury. Another desirable trait of a device for use by law enforcement personnel is a pry tool and a screw driver for removing vehicle tags from vehicles when it is required by law. A further useful device used by law enforcement personnel is a scribe tool which can be used to mark property with identifying characteristics.

Tools for use by emergency personnel have been patented, and include U.S. Pat. No. 5,097,599, issued to Hasegawa, which discloses an emergency escape tool having a spike extending outwardly from a housing. Compression springs work in conjunction with the spike. U.S. Pat. No. 4,268,926, issued to Roxton, discloses a rescue tool having a tool bit with a shaft. A spring engages the tool bit for contacting tool. U.S. Pat. No. 949,470, issued to Geissenhainer, et al., discloses an ice pick having a spring-loaded spindle carried within a handle. U.S. Pat. No. 1,424,221, issued to Trumpeter, also discloses an ice pick having a shank stem which acts in cooperation with springs to drive a pick point into ice.

U.S. Pat. No. 4,947,552, issued to Barnes, discloses a locking system for a knife blade which includes a spring mounted on the outside surface of a handle. The spring includes a foot that passes through a slot in the handle and through a notch in the tang of a blade to lock the blade in an open position. U.S. Pat. No. 5,095,624, issued to Ennis, discloses a locking system for a folding knife wherein a locking pin registers with an opening of a T-shaped toggle to lock the blade in an open position.

Further, U.S. Pat. No. 4,901,439, issued to Boyd, Jr., discloses a locking system for a folding knife, which includes a square-lock block assembly acted upon by a spring.

While the foregoing designs are known, there still exists a need for a single tool which provides law enforcement and emergency medical personnel with a device for reliably breaking automotive glass and for cutting the seat belts of persons trapped in a vehicle. The need also exists for a tool having both the ability to unscrew and pry objects such as unauthorized license tags from vehicles and to etch identifying numbers or marks on property.

SUMMARY OF THE INVENTION

It is, therefore, the principal object of this invention to provide a tool for breaking glass in emergency situations.

It is another object of the present invention to provide a tool for breaking glass which can be easily carried in a pocket, worn on a belt, or carried in a toolbox, medical kit, etc.

It is another object of the present invention to provide an emergency glass breaking tool having an extendable cutting blade.

It is still another object of the present invention to provide an emergency glass breaking tool having a folding pry implement.

It is another object of the present invention to provide an emergency glass breaking tool which reduces the spray of glass upon breakage of the glass.

It is still a further object of the present invention to provide a tool having a folding implement which automatically locks in an extended position and which can be unlocked by the user with one hand.

It is still a further object of the present invention to provide an emergency glass breaking tool having a scribing implement.

Generally, the present invention includes a tool for breaking glass, particularly in emergency rescue situations, for allowing extractions of persons and property from vehicles and contained areas. The tool comprises an elongated body member defining a channel with an impact member slidingly carried in the channel. The impact member has a first end and a second end opposite the first end, and a spring contactable with the first end of the impact member.

The impact member is moveable in the channel between a first, "cocked" position, wherein the spring is compressed against the first end of the impact member, to a second, "impact" position, wherein the impact member extends outwardly from the elongated body member.

A moveable trigger member and cooperating stop member for receiving the moveable trigger member are also provided. Both the moveable trigger member and the cooperating stop member are associated with the input member and the channel. The trigger member is moveable between a first position received in the cooperating stop member, wherein the impact member is in the cocked position, to a second position outside of the cooperating stop member for causing the impact member to thereby break glass.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
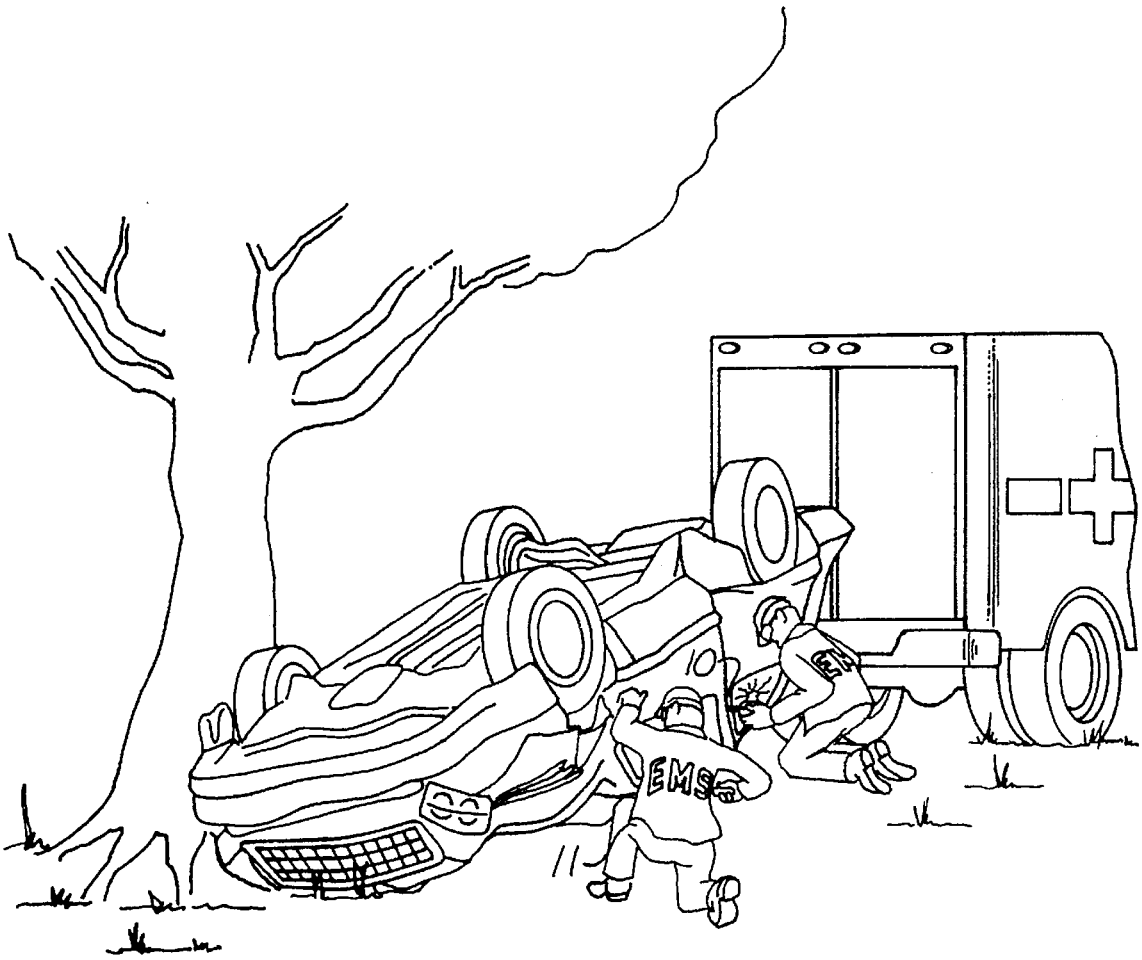
FIG. 1 is a perspective view of use of a tool constructed in accordance with the present invention.

The accompanying drawings and the description which follows set forth this invention in its preferred embodiment. However, it is contemplated that persons generally familiar with tools will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the tool of the present invention is indicated generally in the figures by reference character 10.

FIG. 1 illustrates an accident scene where emergency personnel 11 are at work attempting to remove occupants from an overturned vehicle. The tool 10 of the present invention is being used to break the windows of the automobile to rescue those trapped inside.

Figure 2:
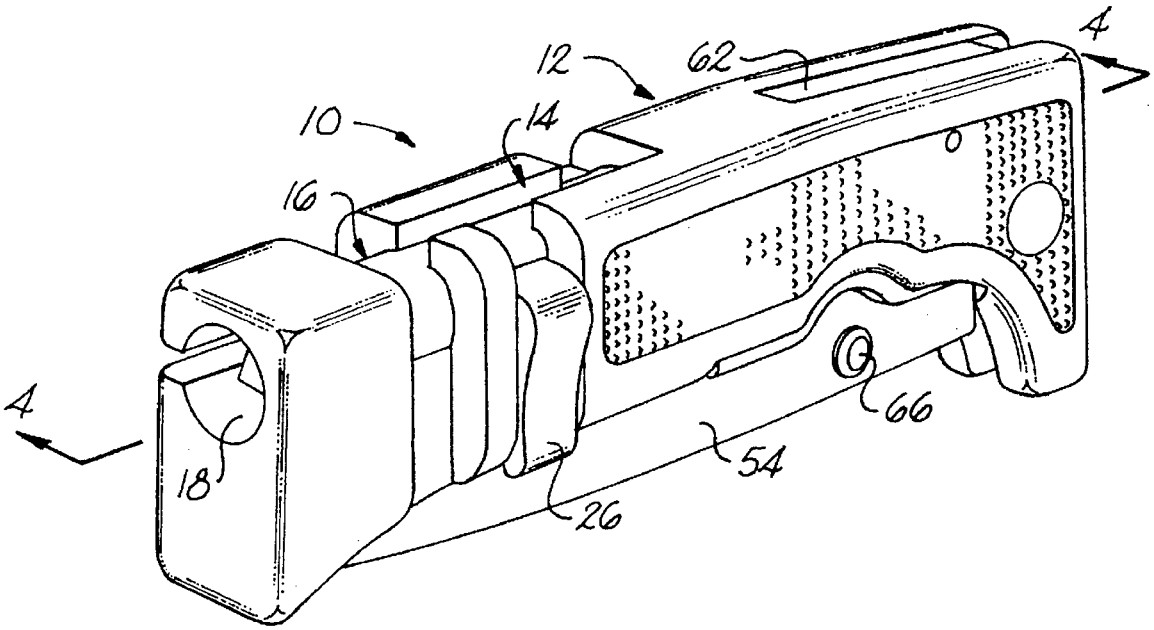
FIG. 2 is a perspective view of a tool constructed in accordance with the present invention with the impact member in a retracted position.
Figure 3A:
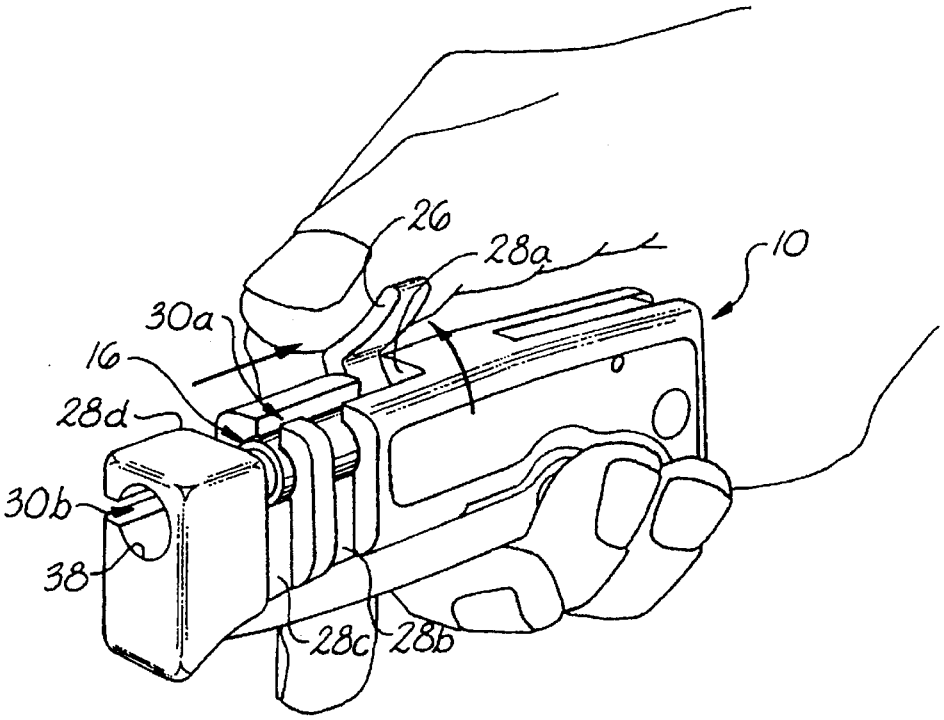
FIG. 3A is a perspective view of a tool constructed in accordance with the present invention with the impact member in a cocked position.
Figure 4:
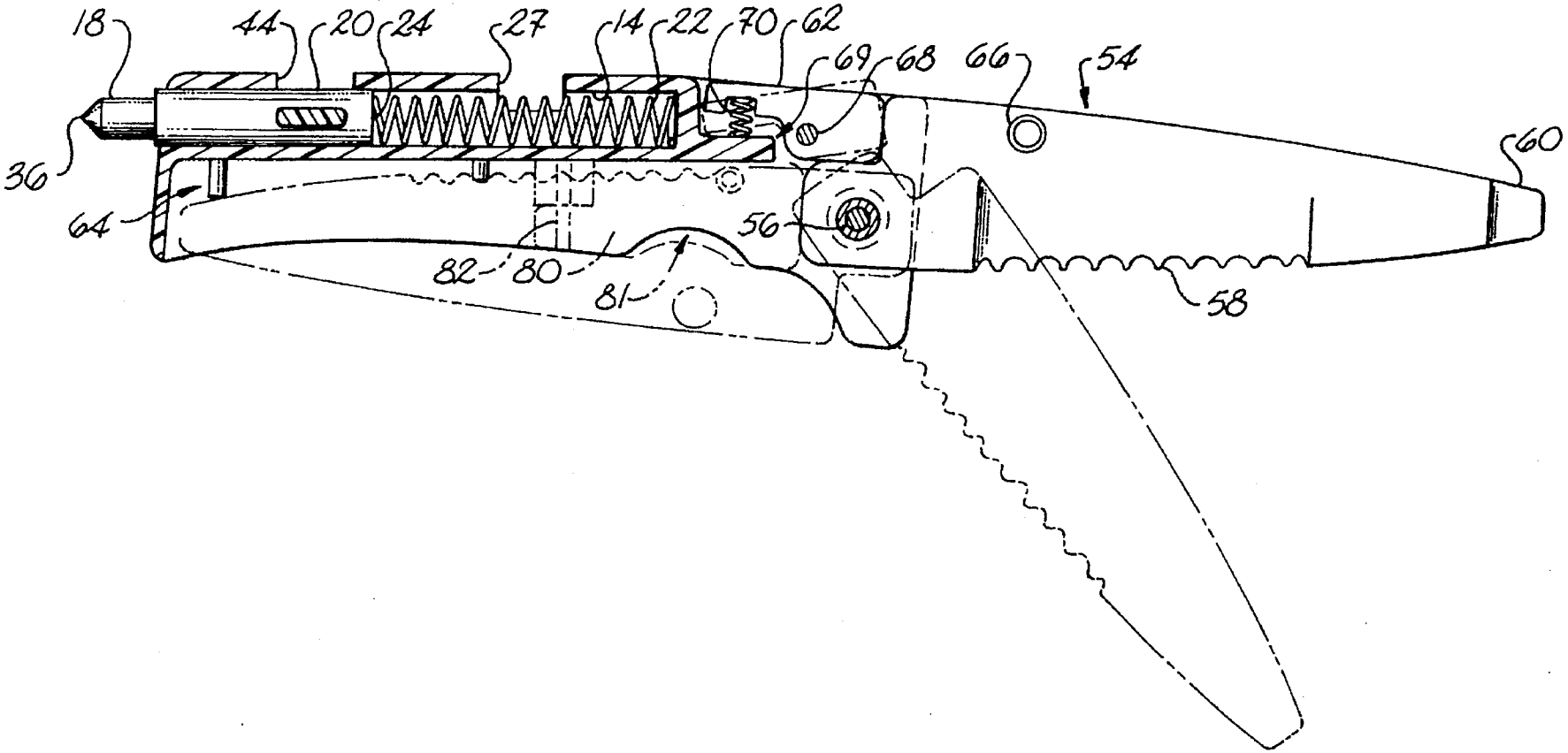
FIG. 4 is a sectional view taken along lines 4—4 of FIG. 2.
Figure 5:
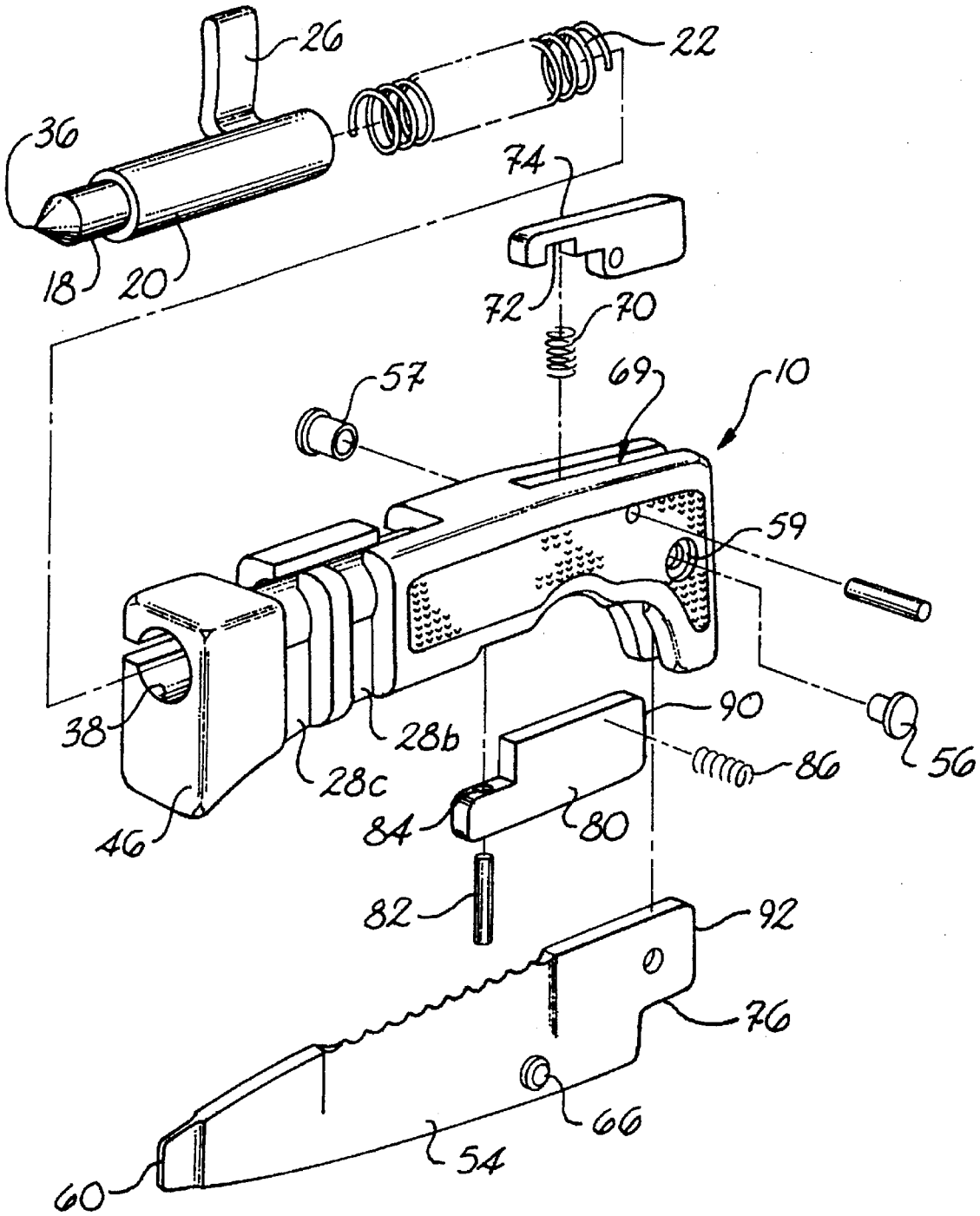
FIG. 5 is an exploded view of a tool constructed in accordance with the present invention.

FIG. 2 illustrates the tool of the present invention which comprises an elongated body member, or handle, generally 12, having an elongated channel, generally 14, provided therein. Handle 12 is preferably molded from plastic, glass-filled nylon, or some other suitable material. An elongated impact member, generally 16, preferably including a carbide-tipped implement 18, is fixedly attached to a generally cylindrically-shaped carrier, moveable within the elongated channel 14. A spring 22 as illustrated in FIGS. 4 and 5, is provided in the channel 14 and contacts one end 24 of the carrier 20 such that as the carrier 20 is moved rearwardly in the channel 14, the spring 22 becomes compressed upon movement of the carrier 20 to a rearwardmost position (as shown in FIG. 3A). A tab, or trigger member, generally 26, is moveable within notches or slots 28*a*, 28*b*, 28*c*, 28*d* and grooves 30*a*, 30*b* provided in the handle member 12. When the carrier 20 is at the rearwardmost position, the trigger member 26 is pivotable about the axis of the carrier 20. At this point, the trigger member 26 is engaged with the trigger cocked position notch 28*a*, against cooperating stop wall 27, provided in the handle. Were the user to release the trigger 26 at this point, the carrier 20 would remain in this rearwardmost position compressing the spring 22 to the fullest. Upon movement of the trigger 26 back to the left, as shown in FIG. 3A, the carrier 20 would be propelled forward under the force of the spring 22 once the trigger 26 cleared the corner 32 of stop wall 27 provided adjacent the slot 28*a* in the handle.

As the carrier 20 is propelled forward, the carbide tip of implement 18 on the front portion of the carrier 20 also advances forward such that it projects outwardly from the barrel opening 38 at the end of the handle 12. The tip 36 is shown at its furthermost outward extent and in an impact position in FIGS. 3B, 3C, and 4.

Instead of being connected to carrier 20, a trigger member (not shown) could be provided which is separate from carrier 20 and engages with carrier 20 to lock the carrier in a locked position. Such a trigger member could be spring-loaded and slidingly carried in handle 12.

The impact member 16 is restrained from exiting the barrel 40 through engagement of the leading edge 42 of the trigger member against a stop 44 provided at the end of the slot 30*a*. When the impact member 16 has moved to its impact position, the trigger can then be moved downwardly to the left as shown by arrow 43 in FIG. 3A to be received in a notch 28*c*, thereby fixing the implement in its impact position to allow use of the implement as a scribing tool. Alternately, the trigger 26 could be rotated to the right, as shown in FIG. 3A, into a notch 28*d*, and then moved forward in a slot 30*b* such that carrier 20 and impact member 16 can be removed from the handle altogether. Likewise, spring 22 could also be removed from the channel 14. This allows the carbide tool 18 or spring 22 to be modified or replaced, if necessary, and also allows from the impact member 16 to be removed altogether from the tool 10 to disable the glass-breaking feature, if desired.

Figure 3B:
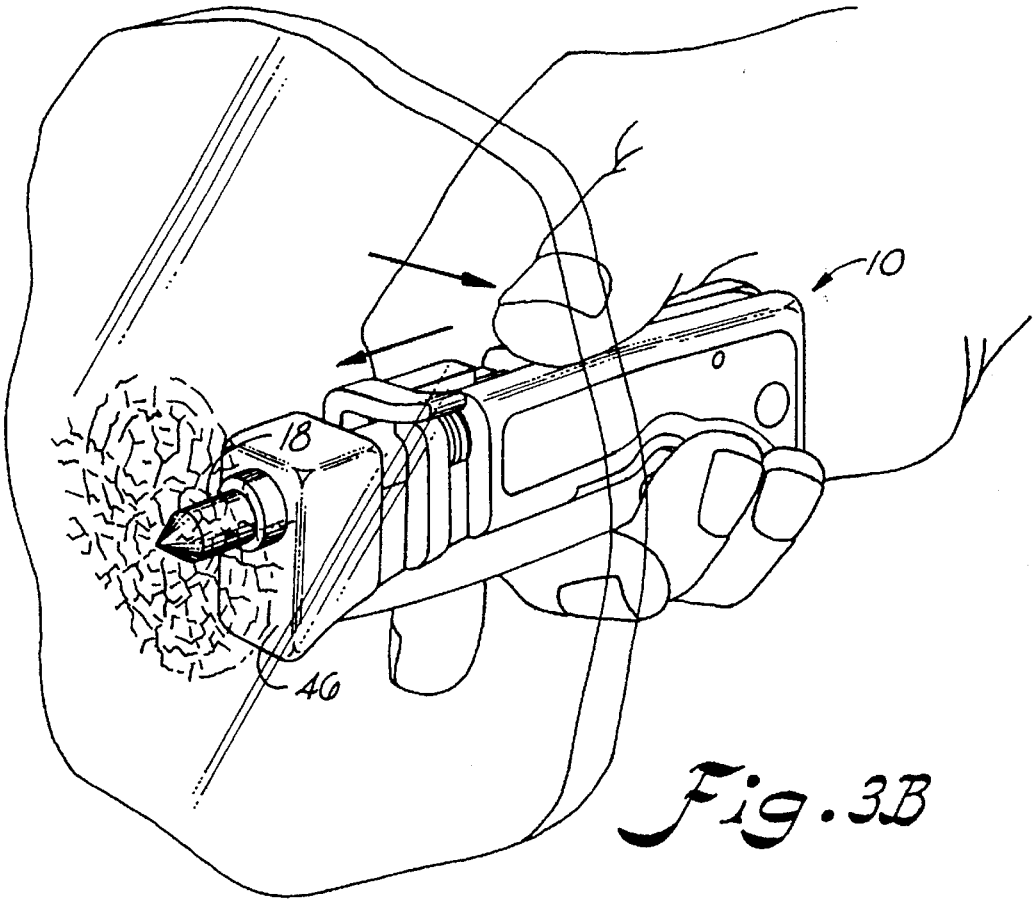
FIG. 3B is a perspective view of a tool constructed in accordance with the present invention at the point of impact of the impact member with glass.
Figure 3C:
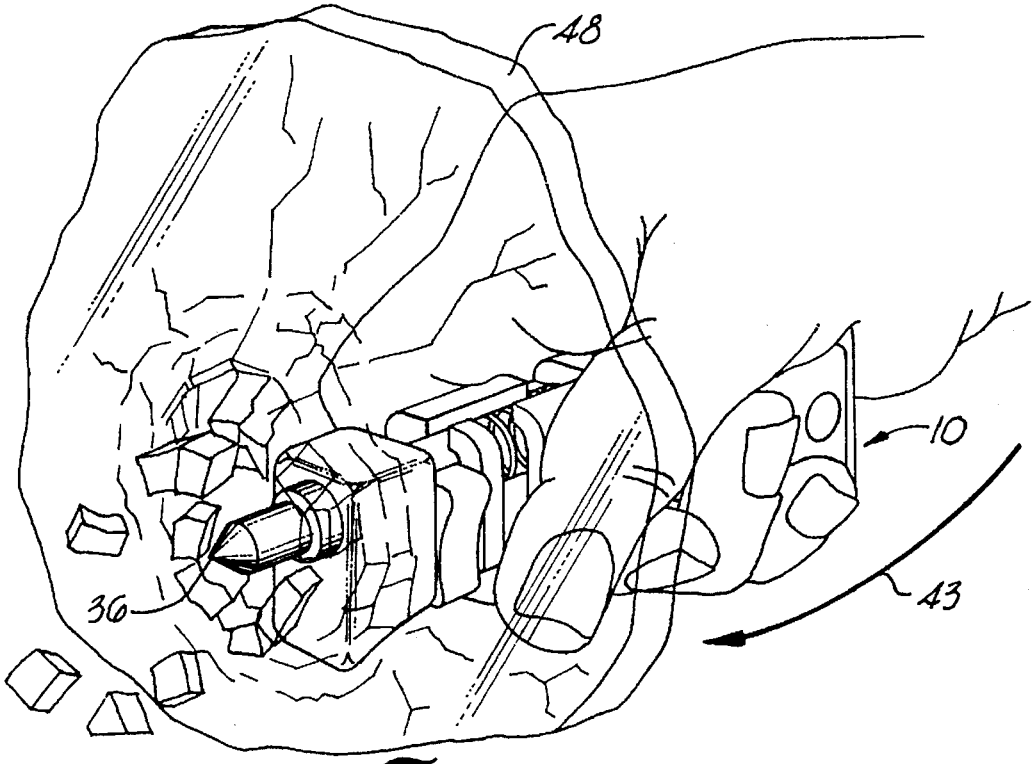
FIG. 3C is a perspective view of a tool constructed in accordance with the present invention showing the impact member penetrating a sheet of glass.

It is to be understood that when using the tool 10 to break glass 48, as illustrated in FIGS. 3B and 3C, the user would place the face of the end 46 of the tool 10 against the glass 48. Cocking of the tool is shown in FIG. 3A. The user should wear heavy duty gloves when performing this function to minimize the risk of being cut by flying shards of glass.

Because of the rapid propulsion of the impact member 18 and the concentration of the force at the point of the carbide tip 36, the glass will likely be broken in a somewhat controlled manner, without the use of blunt objects being thrown into or pounded against the window. Breaking of safety glass, common in automobile side windows, with the tool substantially reduces the risk of large amounts of flying glass, as may otherwise be the case if a large blunt object is used to break the glass.

When not being used, the impact member 16 is carried in a retracted state with the trigger member rotated downwardly toward the left, as shown in FIG. 2, such that the trigger member 16 is received within notch 28*b*.

As illustrated in FIG. 4, the tool 10 also includes a blade 54, preferably constructed of steel (or some other suitable material such as ceramics or plastic) pivotally connected to the handle 12 by a pivotal connector 56, 57, in a bore 59 in handle 12. The blade 54 is preferably provided with a serrated cutting edge 58 for cutting seat belts and thick items, and is also provided with a blunt point 60 in the form of a flat blade screwdriver which can not only be used as a screwdriver, but can also be used as a prying member. A pivoting blade retention member 62 is also provided in the handle 12 for maintaining the blade 54 within a blade cavity 64 in the handle until force is exerted against the blade 54, preferably using a rotatable opening member 66 (which allows for one-handed opening of the blade). Although not shown, member 62 could also slide rectilinearly with respect to handle 12 instead of being pivotally connected to handle 12. The retention member 62 pivots about a pivot shaft 68 provided in a recess 69 in the handle 12, and a coil spring 70 is provided in a recess 72 defined in the retention member 62 for biasing one end 74 of the retention member upwardly. When the knife blade 54 is open, using the rotatable opening member 66, the force of the spring 70 in the retention member is overcome such that the knife blade is moveable to the extended position, as shown in FIG. 4. The purpose of the retention device is to keep the blade 54 within the handle 12, i.e., to keep the blade from pivoting out of the handle in an unrestrained manner when not in use.

The rotatable opening member 66 allows the user to quickly and easily open the knife blade 54 with one hand in that the user would place his or her finger or thumb against the member 66 while holding the handle 12 in the same hand. Because the member 66 is rotatable with respect to the blade, the member and the user's finger or thumb would remain fixed with respect to one another, but the blade 54 would still be able to open since the member 66 rotates with respect to the blade 54 during the pivoting, opening movement of the blade 54. This facilitates easy opening of the blade.

A notch 76 is provided in the blade 54 for engaging with the retention member 62 when the blade 54 is an open configuration. However, a blade lock, generally 78, can also be provided for locking the blade 54 in an open configuration, if desired. Such a blade locking arrangement is illustrated in FIGS. 4 and 5. A blade locking member 80 is received in a recess 81 in the side of the blade cavity 64 of the handle. The blade 54 is also received in the blade cavity 64 when the blade is in a retracted position. A pin 82 is provided in a wall portion 84 of the handle 12 adjacent the blade cavity 64 about which the locking member 80 pivots, through receipt of the pin 82 through a bore 84 provided in the locking member 80. A coil spring 86 is also provided in the recess portion 81 of the handle 12 adjacent the blade cavity for contacting and bearing against one side of the blade lock 80, thereby biasing the blade lock 80 into the blade cavity 64. Thus, when the knife blade 54 is moved to an extended position, the free end 90 of the blade lock 80 will be urged into the blade cavity under the force of the spring 86. The free end 90 of the blade lock consequentially bears against the end 92 of the knife blade 54 to prevent the knife blade from being moved to its retracted position without the user first depressing the locking member 80, against the force of the spring 86, against the wall of the handle adjacent the knife cavity. By so doing, the free end 90 of the locking member will no longer contact the end of the blade 54, and the blade may be freely moved from its extended position to its retracted position.

From the foregoing, it is seen that the tool of the present invention provides a device which may be operated and used by law enforcement and emergency personnel to break glass in a relatively controlled fashion and to also cut seat belts of trapped victims and to do other features as well. These features of the tool can be performed by the user using one hand only, thereby freeing the user's other hand for other purposes.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An impact tool comprising:

an elongated body member having a first end and a second end opposite said first end, said elongated body member defining an elongated channel;

an elongated impact member slidingly carried in said elongated channel, said impact member having a first end and a second end opposite said first end;

a spring contactable with said impact member;

said impact member being moveable in said elongated channel between a cocked position, wherein said spring is compressed by said impact member, to an impact position, wherein said impact member extends outwardly from said first end of said elongated body member; and a trigger member fixedly connected to said impact member, said trigger member extending outwardly from said elongated body member and being rotatable between a first position, wherein said impact member is in said cocked position, to a second position for causing said impact member to move under force of said spring to said impact position.

2. An impact tool as defined in claim 1, further comprising:

said elongated body member defining blade cavity; and an elongated blade pivotally connected to said elongated body member for pivoting between a retracted position within said blade cavity and an extended position extending outwardly from said elongated body member.

3. An impact tool comprising:

an elongated body member having a first end and a second end opposite said first end, said elongated body member defining an elongated channel;

an elongated impact member slidingly carried in said elongated channel, said impact member having a first end and a second end opposite said first end;

a spring contactable with said impact member;

said impact member being moveable in said elongated channel between a cocked position, wherein said spring is compressed by said impact member, to an impact position, wherein said impact member extends outwardly from said first end of said elongated body member;

a trigger member associated with said impact member, said triqger member being moveable between a first position, wherein said impact member is in said cocked position, to a second position for causing said impact member to move under force of said spring to said impact position; and said elongated body member defining a first slot connected to said elongated channel for receiving said trigger member when said impact member is in said cocked position and a second slot connected to said elongated channel for receiving said trigger member when said impact member is in said impact position.

4. An impact tool as defined in claim 3, further comprising said elongated body member defining a third slot connected to said elongated channel for receiving said trigger member when said impact member is between said cocked and impact positions.

5. An impact tool as defined in claim 1, wherein said impact member includes a carbide tip on said second end thereof.

6. An impact tool as defined in claim 1, wherein said trigger member is a tab connected to and extending outwardly from said impact member.

7. An impact tool as defined in claim 2, wherein said elongated blade includes a tip portion configured as a screwdriver.

8. An impact tool as defined in claim 2, further comprising:

a blade retention member connected to said elongated body member and moveable for contacting said elongated blade; and a retention spring between said blade retention member and said elongated body member for urging said blade retention member into contact with said elongated blade for selectively restricting movement of said elongated blade with respect to said elongated body member.

9. An impact tool as defined in claim 2, further comprising a rotatable opening member connected to said elongated blade for facilitating movement of said elongated blade between said retracted and extended positions.

10. An impact tool as defined in claim 2, further comprising:

a blade lock member pivotally connected to said elongated body member for pivoting between a locking position inside of said blade cavity, when said elongated blade is in said extended position, for blocking retraction of said elongated blade member, and an unlocking position substantially outside of said blade cavity; and a lock member spring between said blade lock member and said elongated body member for urging said blade lock member towards said locking position.

11. A tool for breaking glass, the tool comprising:

an elongated body member defining an elongated channel and a stop member associated with said elongated channel;

an elongated impact member slidingly carried in said elongated channel, said impact member having a first end and a second end opposite said first end;

a spring contactable with said impact member;

said impact member being moveable in said elongated channel between a cocked position, wherein said spring is compressed by said impact member to an impact position, wherein said impact member extends outwardly from said elongated member;

a moveable trigger member fixedly connected to said impact member and being contactable with said stop member; and said trigger member extending outwardly from said elongated body member and being rotatable between a first position contacting said stop member, wherein said impact member is in said cocked position, to a second position away from said stop member for causing said impact member to move to said impact position for breaking glass.

12. An impact tool as defined in claim 11, further comprising:

said elongated body member defining blade cavity; and an elongated blade pivotally connected to said elongated body member for pivoting between a retracted position within said blade cavity and an extended position extending outwardly from said elongated body member.

13. An impact tool as defined in claim 12, further comprising:

a blade retention member connected to said elongated body member and moveable for contacting said elongated blade; and a retention spring between said blade retention member and said elongated body member for urging said blade retention member into contact with said elongated blade for selectively restricting movement of said elongated blade with respect to said elongated body member.

14. An impact tool as defined in claim 12, further comprising:

a blade lock member pivotally connected to said elongated body member for pivoting between a locking position inside of said blade cavity when said elongated blade is in said extended position, for blocking retraction of said elongated blade member, and an unlocking position adjacent a side of said blade cavity; and a lock member spring between said blade lock member and said elongated body member for urging said blade lock member towards said locking position.

15. A method of breaking glass, comprising:

providing a tool having a handle defining an elongated channel open to a first end of the handle, an impact member slidingly carried in said elongated channel, and a spring contacting said impact member;

moving a trigger member extending outwardly from said body member and fixedly connected to said impact member of said tool in said elongated channel to a first position, wherein said spring is compressed by said impact member and said impact member is substantially fixed against movement with respect to said handle;

placing said first end of said handle against the glass when said impact member is in said cocked position; and rotating said trigger member to a second position, wherein said impact member is released to move to under force of said spring to an impact position extending outwardly from said first end of said handle for contacting and breaking the glass.

* * * * *